United States Patent [19]

Olson

[11] Patent Number: 4,508,221

[45] Date of Patent: Apr. 2, 1985

[54] TOOL CADDY

[76] Inventor: David V. Olson, 324 IDS Tower, Minneapolis, Minn. 55402

[21] Appl. No.: 303,887

[22] Filed: Sep. 21, 1981

[51] Int. Cl.[3] ..... B65D 5/28

[52] U.S. Cl. ..... 206/379; 206/371; 206/372; 206/443; 206/478; 206/813; 211/69; 211/70.6

[58] Field of Search ..... 206/349, 371, 372, 373, 206/379, 380, 443, 460, 478, 813; 408/239 R, 241 R; 248/205 A; 211/60 T, 69; 145/62, 63; 30/125

[56] References Cited

U.S. PATENT DOCUMENTS

| | | | |
|---|---|---|---|
| 2,824,651 | 2/1958 | Davis | 408/241 R |
| 2,842,260 | 7/1958 | Molitor | 206/379 |
| 2,844,244 | 7/1958 | Hanson | 206/379 |
| 2,862,626 | 12/1958 | Clare | 248/205 A X |
| 3,466,774 | 9/1969 | Borresen | 206/38 |
| 3,895,710 | 7/1975 | Harvell | 206/379 |
| 3,978,984 | 9/1976 | Cowley | 206/379 |

FOREIGN PATENT DOCUMENTS

| | | | |
|---|---|---|---|
| 67590 | 9/1948 | Denmark | 211/69 |
| 83091 | 2/1954 | Norway | 206/373 |
| 2035067 | 6/1980 | United Kingdom | 206/373 |

*Primary Examiner*—William T. Dixson, Jr.
*Assistant Examiner*—Brenda J. Ehrhardt
*Attorney, Agent, or Firm*—Burd, Bartz & Gutenkauf

[57] ABSTRACT

A tool caddy for holding a variety of small tools of varying sizes, such as drill bits, saw blades, or the like. The tool caddy is intended to be adhesively attached to an electric drill or saber saw or the like to keep the interchangeable tool elements readily at hand. The device comprises a flat sheet of flexible material having a plurality of parallel spaced apart longitudinal corrugated tool-receiving pockets on the upper surface of the base sheet. A layer of pressure-sensitive adhesive covers the bottom surface of the base sheet for attachment to a tool housing. A removable peelable cover sheet overlies the adhesive pending application to the tool housing. An elastic strap or band extends transversely over the top surface of the tool-receiving pockets to retain a chuck key, or the like.

6 Claims, 3 Drawing Figures

TOOL CADDY

FIELD OF THE INVENTION

1. Background of the Invention

This invention is directed to a tool holder or caddy for containing a plurality of small interchangeable tool elements, such as drill bits or saw blades or the like. The tool caddy is intended for attachment to the housing of an electric drill or saber saw or the like so that the interchangeable tool elements are readily at hand when needed. This avoids the necessity for rummaging through a tool box or drawer or the like to find the drill bit or saw blade of proper size when needed when the tool is in use.

2. The Prior Art

Various forms of racks, boxes and holders are available for storing interchangeable tool parts, such as drill bits or saw blades, which ordinarily come in a variety of sizes. Such interchangeable tool parts are commonly sold as assortments packaged together in a single box or other container. In each instance, the tool container is intended to hang on a wall or set on a workbench or be carried in a tool box or the like. Accordingly, in most instances, when using a tool such as an electric drill or saber saw, when it is necessary to change or replace the interchangeable tool element, it is generally necessary to lay down the tool and seek out the replacement tool element. Various solutions to this problem have been proposed.

Molitor U.S. Pat. No. 2,842,260 shows a drill bit holder intended for attachment to the drill cord so as to have drill bits readily at hand when using the drill. Harvell U.S. Pat. No. 3,895,710 shows a similar drill bit holder.

Cowley U.S. Pat. No. 3,978,984 shows a drill bit holder formed of flexible material. However, the Cowley drill bit holder is not adaptable for attachment to the drill housing. An essential feature of the Cowley device is that the backing sheet must be capable of being flexed in use so as to separate a drill bit retaining flange from the tips of the drill bits in order to permit them to be removed from the holder.

SUMMARY OF THE INVENTION

The present invention is directed to a tool holder or caddy intended to be attached directly to the tool housing, for holding a plurality of small interchangeable tools of varying sizes. The tool caddy comprises a flat base sheet of flexible material capable of conforming to the surface of the tool housing. A layer of pressure-sensitive adhesive is applied to the bottom surface of the base sheet for adherence to the tool housing surface. A removable peelable cover sheet overlies the adhesive until the base sheet is applied to the tool housing. A plurality of parallel spaced apart longitudinal tool-receiving pockets are attached to the upper surface of the flexible base sheet. These tool-receiving pockets are formed from flexible resilient sheet material attached to the base sheet and folded into corrugations. The bottom surfaces of the furrows of the corrugations are sealed to the top surface of the base sheet. Preferably an elastic strap or band extends transversely over the top surface of the tool-receiving pockets.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
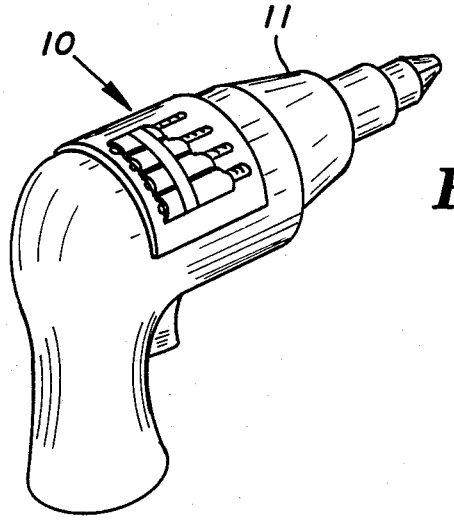
FIG. 1 is a perspective view of a power tool having the tool caddy of the present invention adhered to the housing.

Referring now to the drawings, the tool holder or caddy according to the present invention is indicated generally at 10. FIG. 1 shows the tool caddy 10 mounted, as intended, on the top housing surface of a power tool, such as the electric drill 11 shown. Depending upon the preference of the operator, the tool caddy may be mounted so that the interchangeable tool elements are removed and inserted either from the side closest to the operator when the tool is in use, or from the opposite side, as shown.

Figure 2:
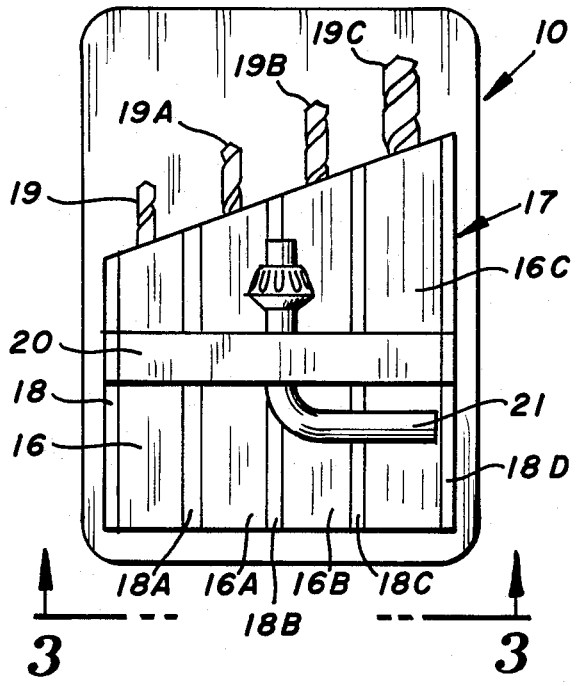
FIG. 2 is a top plan view of the tool caddy of the present invention shown as holding drill bits.
Figure 3:
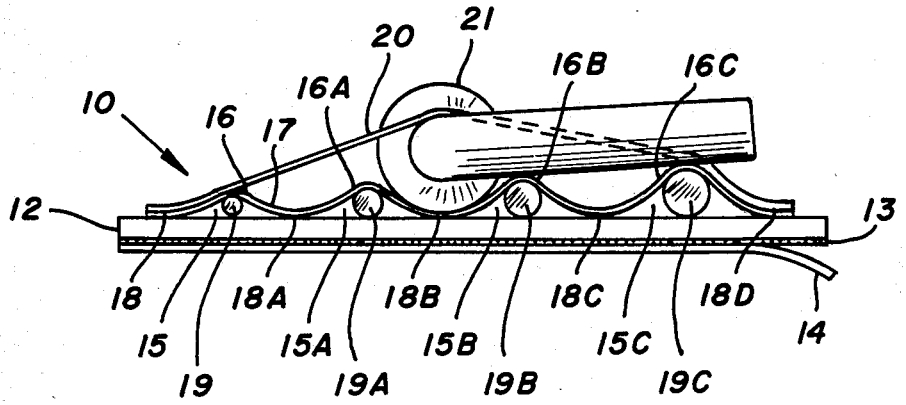
FIG. 3 is an end elevation on an enlarged scale along the line 3—3 of FIG. 2.

Referring especially to FIGS. 2 and 3, the tool caddy 10 comprises a flexible base sheet 12 of generally rectangular configuration and of a size appropriate to the number and nature of tool elements to be held therein. A layer of pressure-sensitive adhesive 13 is applied to the bottom surface of base sheet 12 to adhere the tool caddy to the tool housing. A removable peelable cover sheet 14 is applied over the pressure-sensitive adhesive layer until attachment of the tool caddy to the tool housing.

The upper surface of the tool caddy comprises a plurality of tool-receiving pockets 15, 15A, 15B, etc. formed between the surface of base sheet 12 and the ridges 16, 16A, 16B, etc. of a corrugated flexible sheet 17 of resilient or elastic material. The under surfaces of the furrows 18, 18A, 18B, etc. of corrugated resilient sheet 17 are secured to the top surface of base sheet 12 as by means of heat sealing, adhesive sealing, rivets, staples, or the like. The pockets within the ridges extend in longitudinal parallel alignment spaced apart by the parallel longitudinal furrows.

Replaceable interchangeable tool elements, in this instance drill bits 19, 19A, 19B, etc., are inserted in the pockets 15, 15A, etc. As shown, the drill bits are of varying sizes. As shown in FIG. 3, the pockets 15, 15A, etc. are open-ended. Preferably the height of each ridge and the corresponding tool-receiving pocket is slightly less than the height or diameter of the tool element to be inserted therein, such that the fabric of sheet 17 must be stretched very slightly to insert the tool element. This insures that the tool element is securely held and retained in the caddy, even though subjected to vibration, etc. from the use and operation of the power tool on which the tool caddy is mounted.

As shown in FIG. 2, the length of flexible sheet 17 is less than the length of the base sheet 12 so that one end of the tool element inserted into a tool-receiving pocket extends beyond the end of the pocket for easy removal. Preferably, the tool-receiving pockets are of progressively increasing width and progressively increasing length corresponding to the progressively increasing size of the tool elements to be inserted in the pockets. To this end, one edge of corrugated flexible sheet 17 extends obliquely relative to the corresponding edge of the base sheet.

A resilient or elastic strap or band 20 overlies the ridges of corrugated sheet 17. As seen in FIG. 2, band 20 is narrow relative to the length of the tool-receiving pockets. The ends of band 20 are secured to the base sheet by means of adhesive, heat sealing, rivets, staples, or the like, either directly, or indirectly, as shown, by attachment to the intermediate sheet 17. Band 20 can be stretched and lifted above the tops of the ridges of the corrugated sheet to hold a tool accessory, such as chuck key 21, as shown in broken lines in FIG. 3.

Although the invention is illustrated in conjunction with an electric drill and drill bits, it is equally applicable to holding other tool elements for use in other power tools such as a saber saw and interchangeable saw blades, a power screw driver and interchangeable screw driver blades, and the like. Although illustrated as having four tool-receiving pockets, the caddy may be made to hold fewer or more interchangeable tool elements, as desired.

Base sheet 12, corrugated sheet 17, and band 20 may all be made from rubber or synthetic resinous rubber-like material such as polyvinylchloride, silicones, etc. Preferably the base sheet 12 is of slightly greater thickness than sheet 17 and band 20. The adhesive 13 may be any of the commercially available pressure-sensitive adhesives, preferably one being resistant to softening under such heat as may be generated within the power tool housing. The cover sheet 14 is one which has a glazed or polished surface such that it adheres only lightly to the adhesive and may be readily removed by peeling.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A tool caddy for holding a plurality of small tools of varying sizes, said caddy comprising:

(A) a flat base sheet of flexible material, (B) a flexible corrugated sheet of resilient material on the upper surface of said base sheet, said corrugated sheet having alternating parallel ridges and furrows, the ridges of which form a plurality of open-ended parallel spaced apart longitudinal tool-receiving pockets and the bottom surfaces of the furrows of which are sealed to the top surface of said base sheet, and (C) means for securing said tool caddy to the housing of a portable hand power tool.

2. A tool caddy according to claim 1 wherein said means for securing said caddy comprises:

(A) a layer of pressure-sensitive adhesive on the bottom surface of said base sheet, and (B) a removable peelable cover sheet overlying said adhesive.

3. A tool caddy according to claim 1 wherein said furrows are heat sealed.

4. A tool caddy according to claim 1 wherein said furrows are adhesively sealed.

5. A tool caddy according to claim 1 wherein said tool-receiving pockets are of progressively varying length and width to accommodate tools of progressively varying size.

6. A tool caddy according to claim 1 wherein an elastic strap or band extends transversely over the top surface of said tool-receiving pockets spaced from the ends thereof, the ends of said strap or band being secured to the base sheet.

* * * * *